US006896569B1

(12) United States Patent
Wittenrich

(10) Patent No.: US 6,896,569 B1
(45) Date of Patent: May 24, 2005

(54) FLOAT TUBE COVER

(76) Inventor: Linda J. Wittenrich, 17435 N. 7th St., #1026, Phoenix, AZ (US) 85022

( * ) Notice: Subject to any disclaimer, the term of this patent is extended or adjusted under 35 U.S.C. 154(b) by 0 days.

(21) Appl. No.: 10/603,103

(22) Filed: Jun. 23, 2003

(51) Int. Cl.[7] ..... B63B 1/00
(52) U.S. Cl. ..... 441/66; 441/67; 441/131; 114/346
(58) Field of Search ..... 441/65, 66, 67, 441/129, 131; 114/346, 347, 351

(56) References Cited

U.S. PATENT DOCUMENTS 2,529,961 A * 11/1950 Phillips ..... 441/131
3,871,042 A * 3/1975 Farmer ..... 114/346
4,546,877 A * 10/1985 Evans ..... 206/315.11
4,613,311 A * 9/1986 Wood ..... 441/130
5,899,782 A * 5/1999 Martin ..... 441/66
6,368,171 B1 * 4/2002 Fuller et al. ..... 441/40

* cited by examiner

*Primary Examiner*—Stephen Avila
(74) *Attorney, Agent, or Firm*—William D. Kiesel; Roy, Kiesel, Keegan and Denicola

(57) ABSTRACT

A float tube cover for covering the exterior of an inflated inner tube or the like with a fabric material which will prevent adhesive burns and abrasions and also prevent the inner tube from becoming excessively heated from exposure to the sun. The cover is desirably provided with a leash to allow the user to retrieve the tube should the fall off of the tube as well as one or more pockets for holding items such as suntan lotion, sunglasses, and the like.

1 Claim, 1 Drawing Sheet

FLOAT TUBE COVER

TECHNICAL FIELD

The present invention relates to covers for inflatable inner tubes and more particularly to a cloth cover designed to stretch around the exterior of an inflated ring-shaped tube that is provided with a number of attachment clasps along the inner edge thereof for securing the cover over the inflated ring-shaped tube, a hand leash that is attachable at one end to the wrist of the user and permanently attached to the cover at the other end; the cover including one or more pockets for storing items for use while engaged in tubing in a body of water such as suntan lotion, sunglasses, etc.

BACKGROUND OF INVENTION

Many individuals enjoy floating around bodies of water, such as lakes, streams, and rivers, in an inflated inner tube which is constructed from an elastic rubber material. Although they enjoy this activity, the elastic rubber material can sometimes become heated due to exposure to the sun and may also become adhesively attached to the skin causing abrasions and burns. It would be desirable, therefore, to have a fabric cover that could be positioned over the inner tube to prevent these things from occurring. In addition, because individuals sometimes fall off of the inner tube, it would also be desirable to have a leash attached at one end to the cover having a second end which a user could attach around his/her wrist so that should they fall off the inner tube they could easily retrieve the inner tube by pulling the leash. A pocket on the cover would also be desirable for holding items that may be needed during the float trip such as suntan lotions and the like.

SUMMARY OF INVENTION

It is thus an object of the invention to provide a float tube cover that is designed to stretch around the exterior of an inflated ring-shaped tube that is provided with a number of attachment clasps along the inner edge thereof for securing the cover over the inflated ring-shaped tube, a hand leash that is attachable at one end to the wrist of the user and permanently attached to the cover at the other end; the cover including one or more pockets for storing items for use while engaged in tubing in a body of water such as suntan lotion, sunglasses, etc.

Accordingly, a float tube cover is provided. The float tube cover is designed to stretch around the exterior of an inflated ring-shaped tube that is provided with a number of attachment clasps along the inner edge thereof for securing the cover over the inflated ring-shaped tube, a hand leash that is attachable at one end to the wrist of the user and permanently attached to the cover at the other end; the cover including one or more pockets for storing items for use while engaged in tubing in a body of water such as suntan lotion, sunglasses, etc.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figures 1, 2, 3:
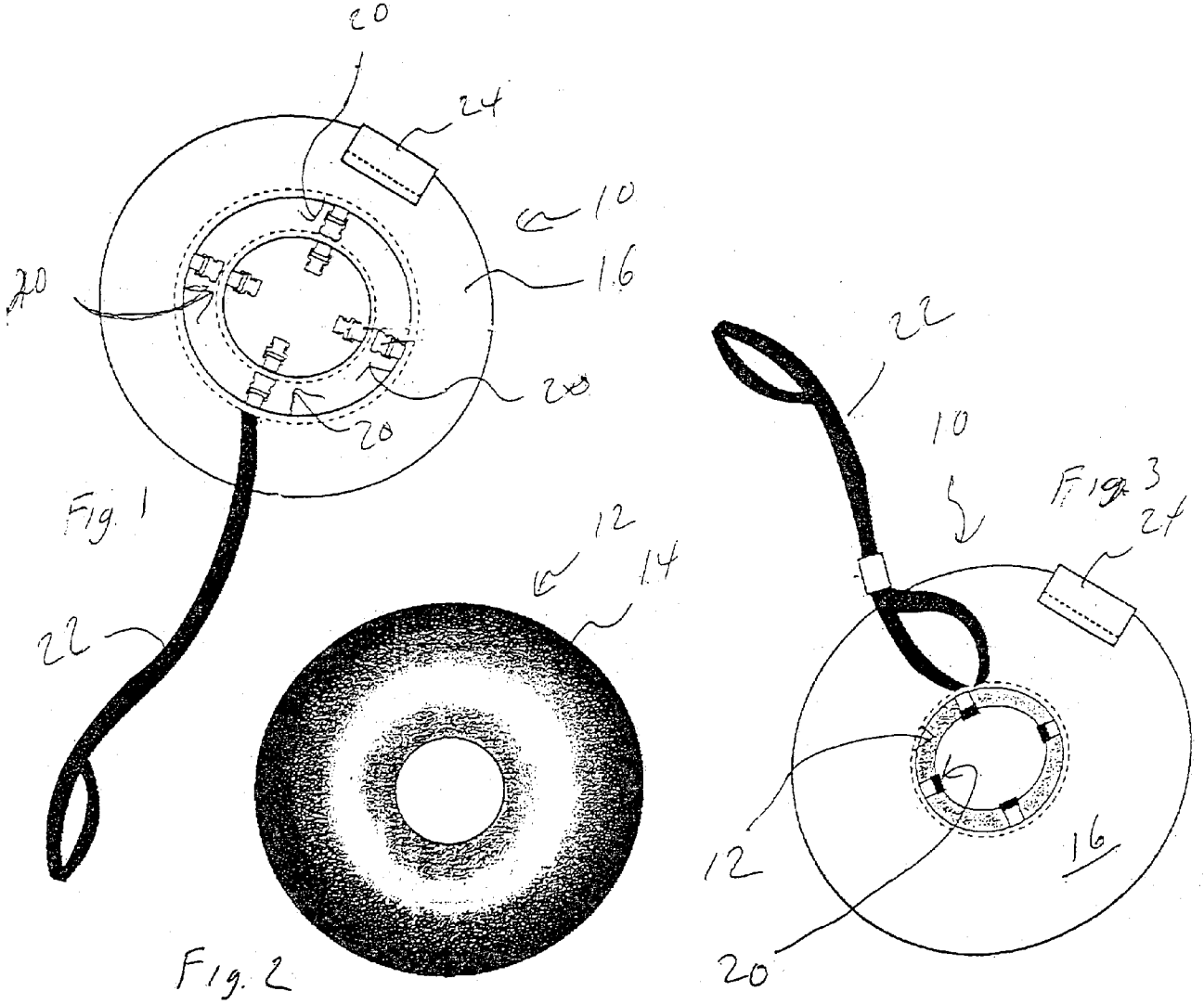
FIG. 1 is a top plan view of an exemplary embodiment of the inner tube cover of the present invention.
FIG. 2 is a top plan view of an inner tube without the cover.
FIG. 3 shows the cover placed over the inner tube of FIG. 2.

FIGS. 1 through 3 show various aspects of an exemplary embodiment of the float tube cover of the present invention generally designated 10. Float tube cover 10 is adapted for use with a ring-shaped inflatable tube, generally designated 12, that is constructed from a dark resilient rubber material 14 that can adhere to skin surfaces when dry and which can become very hot when subjected to direct sunlight.

Float tube cover 10 is constructed from a fabric material 16 and is shaped to surround inflatable ring-shaped tube 12 and connect along the inner edges thereof with four sets of clasps each generally designated 20. In this embodiment float tube cover 10 is provided with a flexible hand leash 22 and a pocket 24 for holding items such as sunglasses or suntan lotion.

It can be seen from the preceding description that a float tube cover has been provided.

It is noted that the embodiment of the float tube cover described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

The invention claimed is:

1. A float tube cover for use with inflated, resilient ring-shaped tubes; the float tube cover comprising:

a cloth cover designed to stretch around an exterior of an inflated ring-shaped tube;

said cloth cover being provided with a four attachment clasps spaced in an equidistant relationship along an inner edge thereof for securing said cloth cover over said inflated ring-shaped tube;

said float tube cover further including a hand leash that is snugly attachable at one end thereof to the circumference of a wrist of a user and permanently attachable to at least one of said attachment clasps of the cloth cover at the other end;

said cloth cover including one or more pockets for storing items for use while engaged in tubing on a body of water wherein at least on the said pockets is attached directly opposite of the hand leash on the cloth cover.

* * * * *